US006347921B1

(12) United States Patent
Watanabe et al.

(10) Patent No.: US 6,347,921 B1
(45) **Date of Patent: *Feb. 19, 2002**

(54) TURBOMACHINE

(75) Inventors: Hiroyoshi Watanabe; Shin Konomi, both of Yokohama; Hideomi Harada, Fujisawa; Iciro Ariga, Yokohama, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/542,869

(22) Filed: Apr. 4, 2000

Related U.S. Application Data

(63) Continuation-in-part of application No. 09/167,722, filed on Oct. 7, 1998.

(51) Int. Cl.[7] ..... F01D 1/06
(52) U.S. Cl. ..... 415/211.2

(58) Field of Search ..... 415/208.4, 150, 415/211.2, 224.5, 208.3, 157, 158, 159

(56) References Cited

U.S. PATENT DOCUMENTS 6,155,779 A * 12/2000 Watanabe et al. ..... 415/150

* cited by examiner

*Primary Examiner*—Edward K. Look
*Assistant Examiner*—James M McAleenan
(74) *Attorney, Agent, or Firm*—Armstrong, Westerman, Hattori, McLeland & Naughton, LLP

(57) ABSTRACT

A centrifugal or mixed flow type turbomachine, of a vaneless diffuser type can operate stably at low flow rates below the design flow rate, by preventing the initiation of flow instability in the system. The turbomachine comprises two stabilization members disposed in two predetermined locations of the diffuser section which prevents a generation of unstable flow in the diffuser section during a low flow rate operation and reduction of head coefficient in the turbomachine.

9 Claims, 18 Drawing Sheets

Operating point ①

Operating point ①

Operating point ②

Operating point ②

Operating point ③

TURBOMACHINE

This is a continuation-in-part of application Ser. No. 09/167,722, filed Oct. 7, 1998.

BACKGROUND OF THE INVENTION

1. Field of the Invention

The present invention relates in general to centrifugal and mixed flow turbo-machineries (pumps, blowers and compressors), and relates in particular to a vaneless diffuser turbomachine that can operate over a wide flow rate range, by avoiding flow instability generated at low flow rates.

2. Description of the Related Art

When a centrifugal or mixed flow turbomachine is operated at low flow rates, stream separation can occur in some parts of the fluid compression system, such as impeller and diffuser, thus leading to a reduction in pressure increase factor for a given flow rate, and producing a phenomenon of flow instability (rotating stall and surge) to make the system inoperable.

A current trial to resolve this problem is to maintain minimum flow rate by providing bypass pipes or blow-off valves in the system so that the supply of fluid to the equipment to be operated is reduced. However, the volume flow in the impeller of the turbomachine remains unchanged, thus presenting a problem that the energy is being consumed wastefully.

SUMMARY OF THE INVENTION

It is an object of the present invention to provide a centrifugal or mixed flow type turbomachine, of a vaneless diffuser type, which can operate stably at low flow rates below the design flow rate, by preventing the initiation of flow instability in the system (rotating stall and surge).

The object has been achieved in a turbomachine having an impeller and a vaneless diffuser section, wherein two stabilization members are disposed in a predetermined location of the diffuser section so as to prevent a generation of unstable flow in the diffuser section during a low flow rates operation. Accordingly, a relatively simple approach is employed to avoid generating a phenomenon of reversed flow in the diffuser section, thereby providing a turbomachine that can operate efficiently at a lower overall cost. Also, only two stabilizing members in the diffuser prevent the head coefficient in the turbomachine from being decreased.

The stabilization member may be formed as a plate member.

The plate member may be installed so as to span across an entire width of a fluid flow path of the diffuser section.

In the turbomachine, a height dimension of the plate member may be smaller than a width dimension of a fluid flow path of the diffuser section so as to provide a space between the plate member and an opposing wall surface of the diffuser section. A suitable amount of space is effective to suppress the reversed flow in the diffuser section.

The stabilization member maybe inserted into or retracted away from the diffuser section by plate driver means.

The plate member may have a height h which is related to a width dimension $b_3$ of the diffuser section according to a relation, $h/b_3>0.5$.

The plate member may be aligned at an angle greater than that of a stream flowing at a rotating stall initiating flow rate into the diffuser section.

DETAILED DESCRIPTION OF THE PREFERRED EMBODIMENTS

In the following, preferred embodiments will be presented with reference to the drawings.

Figure 1:
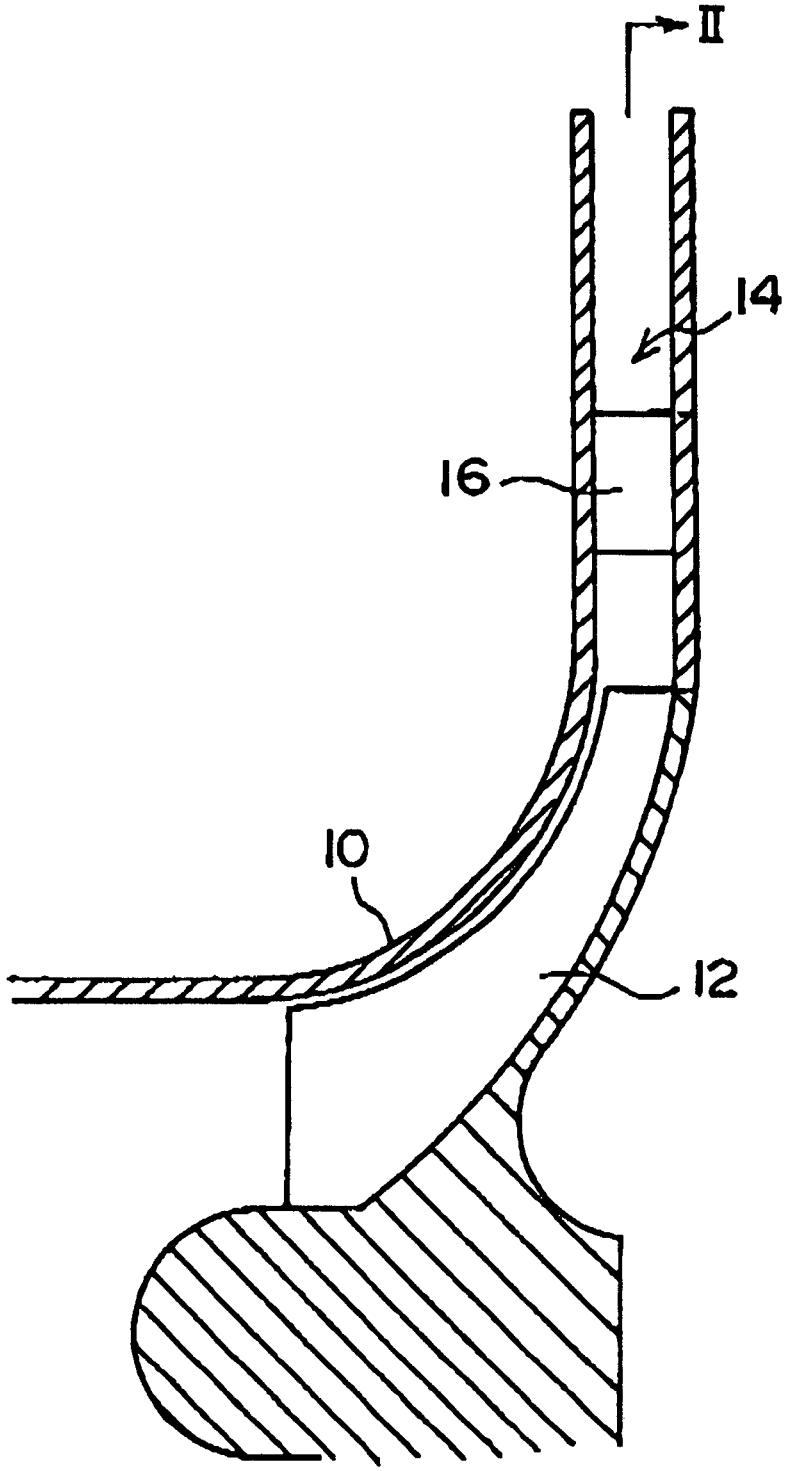
FIG. 1 is a partial cross sectional view of a first embodiment of the turbomachine of the present invention.
Figure 2:
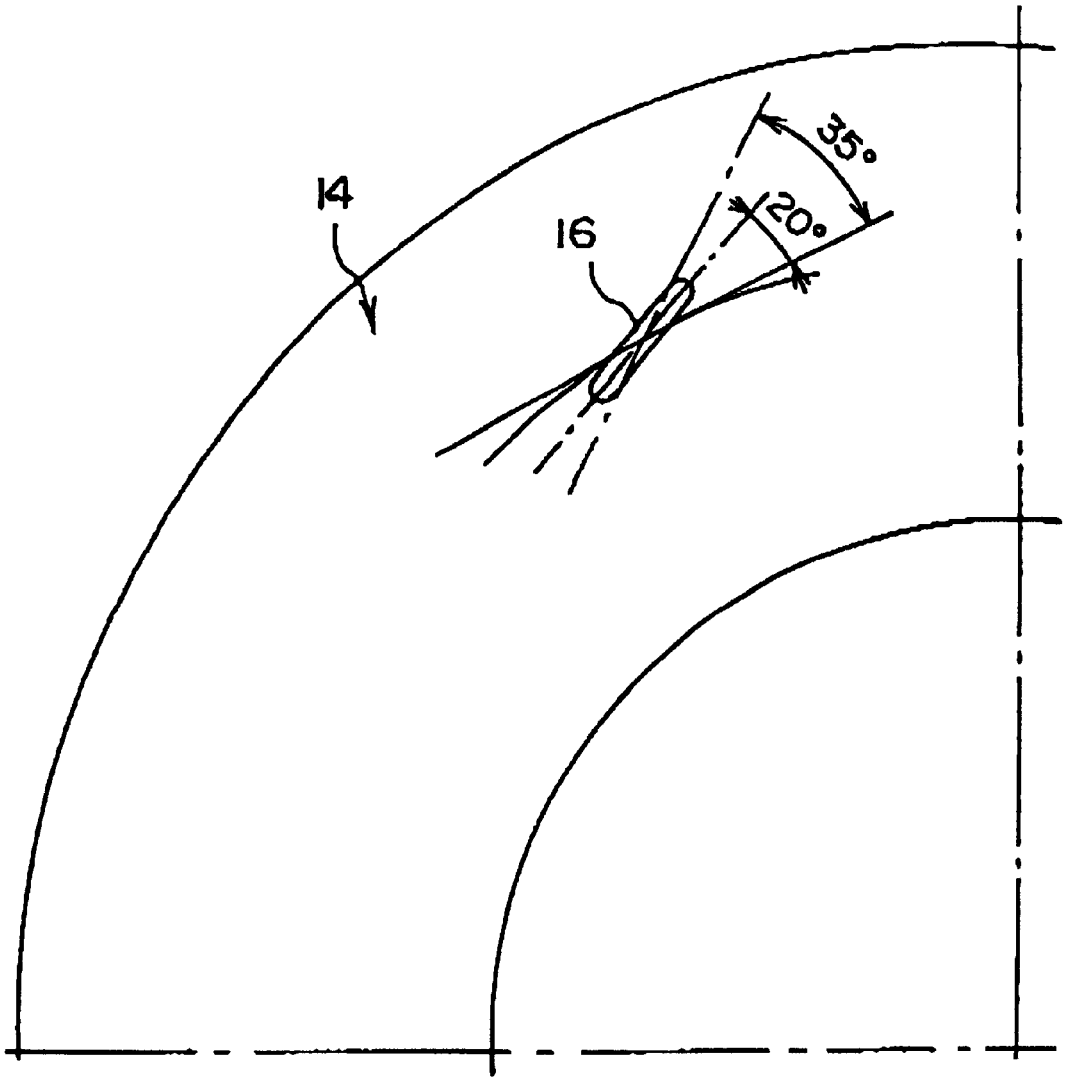
FIG. 2 is a sectional view seen through a plane at II in FIG. 1.

FIGS. 1 and 2 show a first embodiment of the centrifugal type turbomachine, which comprises a pump casing 10, a rotatable impeller 12 housed inside the casing 10, and a vaneless diffuser section 14 having a stationary stabilization plate 16 provided in certain location of the diffuser section 14 to prevent flow instability in a reverse flow region.

Only one stabilization plate 16 is provided in the embodied pump, but two or more stabilization plates may be provided. The significance of locating the stabilization plate 16 within the diffuser section 14 will be explained below in terms of the differences in the performance of a turbomachine with and without such a plate.

Figure 3:
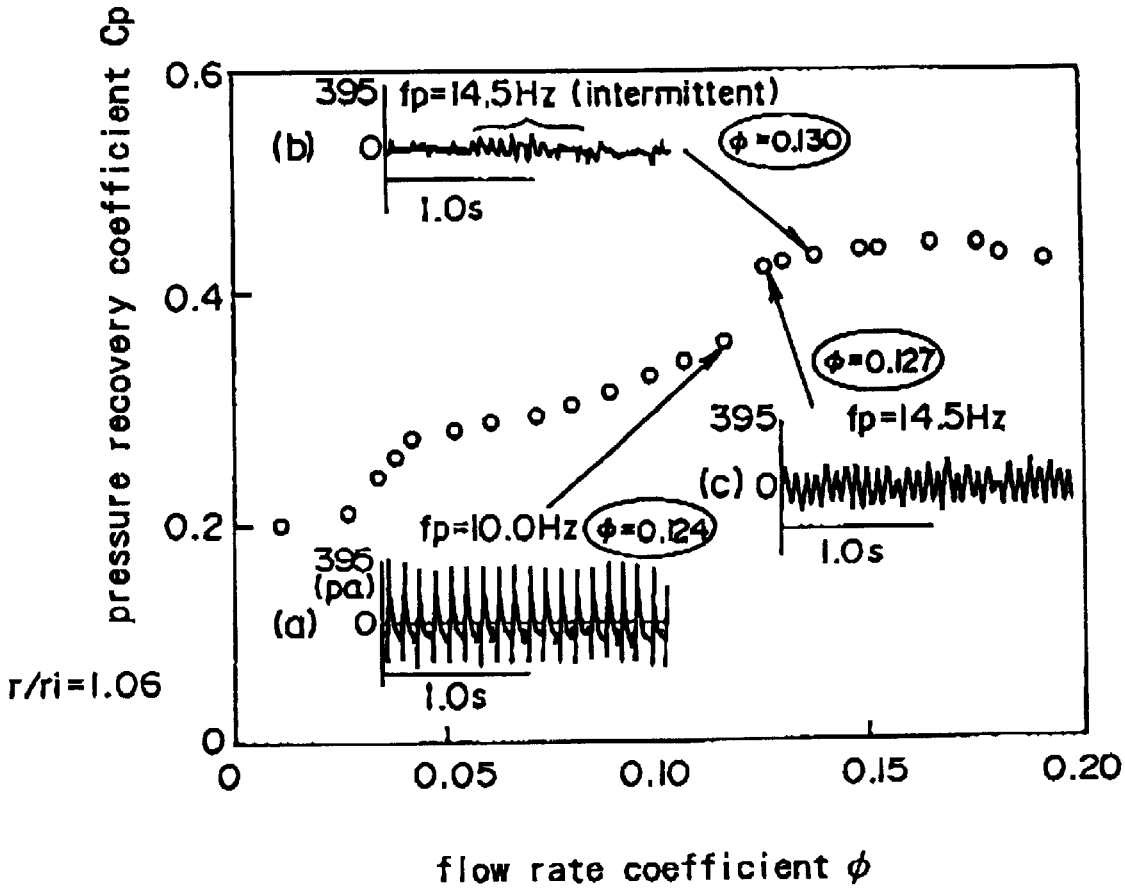
FIG. 3 is a graph of pump performance in terms of the pressure recovery coefficient Cp and flow rate coefficient $\phi$ in a conventional vaneless diffuser turbomachine.

FIG. 3 shows the performance of a turbomachine, having a conventional vaneless diffuser section, in terms of a pressure recovery coefficient Cp. The design flow coefficient of this compressor is 0.35, which means that all the data in this graph belong to the low flow region, below the design flow rate. Observation of changes in the static pressure on the inner surface of the front shroud at the inlet to the diffuser are indicated by open circles in FIG. 3. As the flow rate through the turbomachine is decreased, pressure fluctuations at a peak frequency fp=14.5 Hz begin to appear intermittently for a flow coefficient $\phi$=0.13 as indicated by (b). When the flow rate is decreased only slightly to $\phi$=0.127, both amplitude and frequency of vibration are observed to increase as shown by (c). This fluctuation of flow region at fp=14.5 Hz is designated as fluctuation ①.

When the flow rate is further decreased to $\phi$=0.124 as shown by (a), waveforms of static pressure and amplitude suddenly change, and Cp begins to drop discontinuously. The flow rate, at $\phi$=0.124, corresponds to an initiation of so called rotating stall where reversed flow region formed between the diffuser outlet and the impeller outlet rotate circumferentially.

Figure 4:
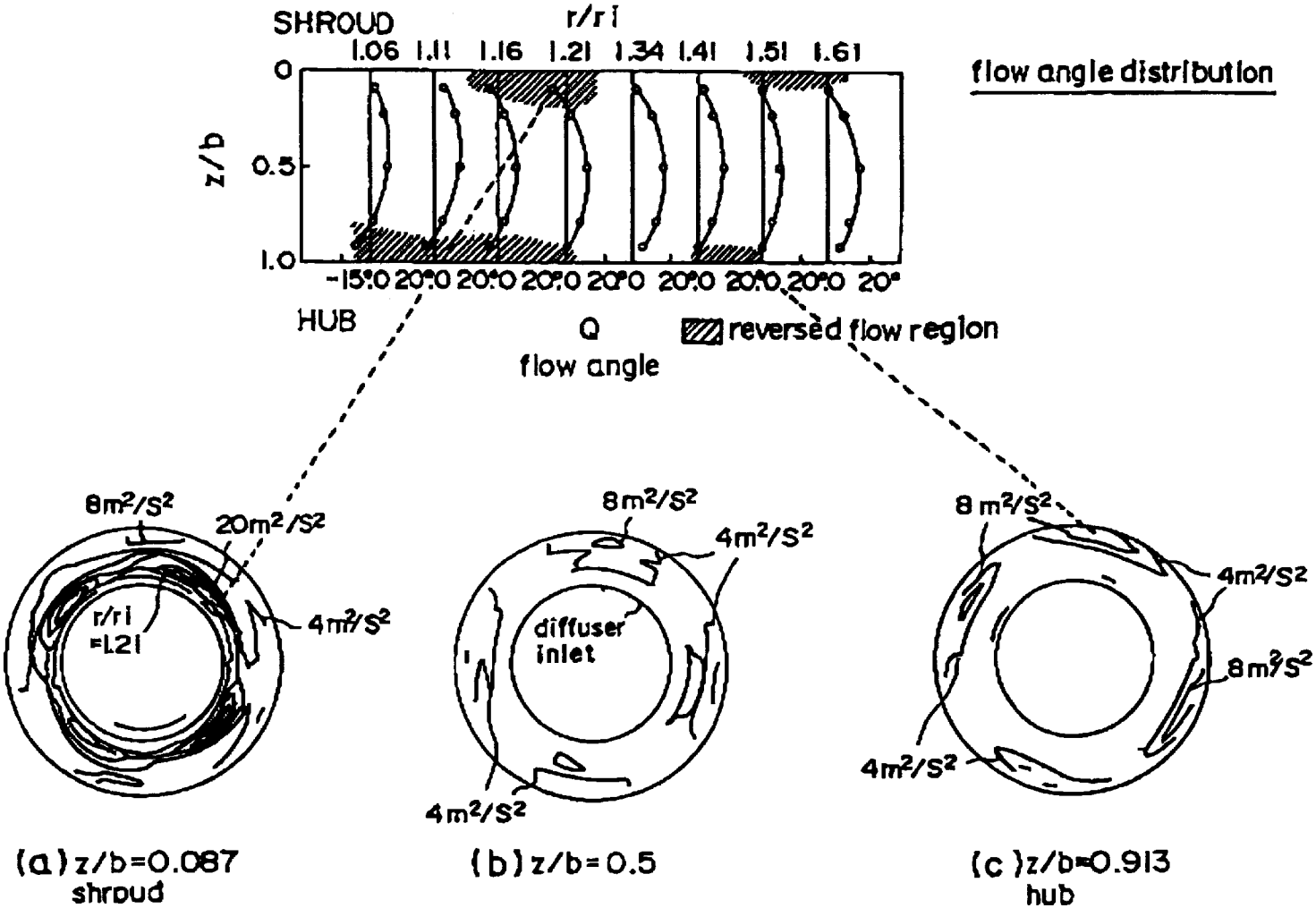
FIG. 4 illustrates distributions of average flow angle and periodic velocity fluctuation energy in the diffuser without a stabilization plate.

FIG. 4 is a series of graphs showing distributions of average flow angle and periodic velocity fluctuation energy within the diffuser while the fluctuation is generated. The hatched regions in the graph of flow angle distribution refer to annular reversed flow regions where the average flow angle is negative. Periodic velocity fluctuation energy patterns (a)–(c) indicate that fluctuation is particularly severe in the reversed flow region given by (r/ri)=1.21. These results indicate that the pressure fluctuation occurring at fp=14.5 Hz is caused by instability in the annular reversed flow regions periodically rotating within the diffuser. It shows that the development of fluctuation in the annular reversed flow regions, produced at a flow rate just slightly higher the rotating stall flow rates, acts as the trigger for generating a rotating stall.

Figure 5:
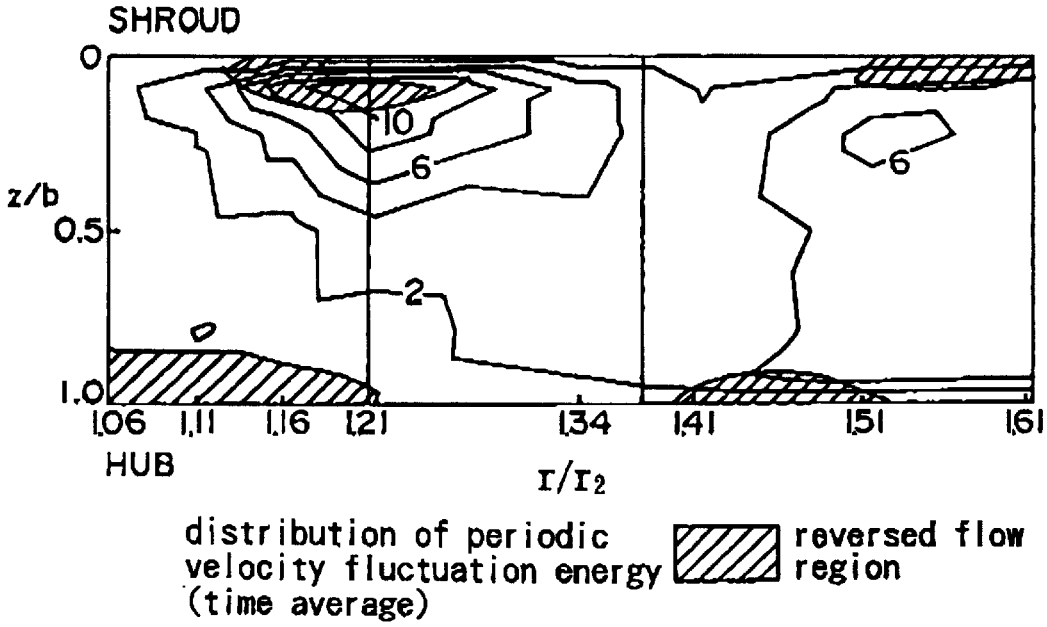
FIG. 5 is a graph showing the distribution of square amplitude of periodic velocity fluctuation in the conventional vaneless diffuser and the position in which stabilization plate is disposed.
Figure 6:
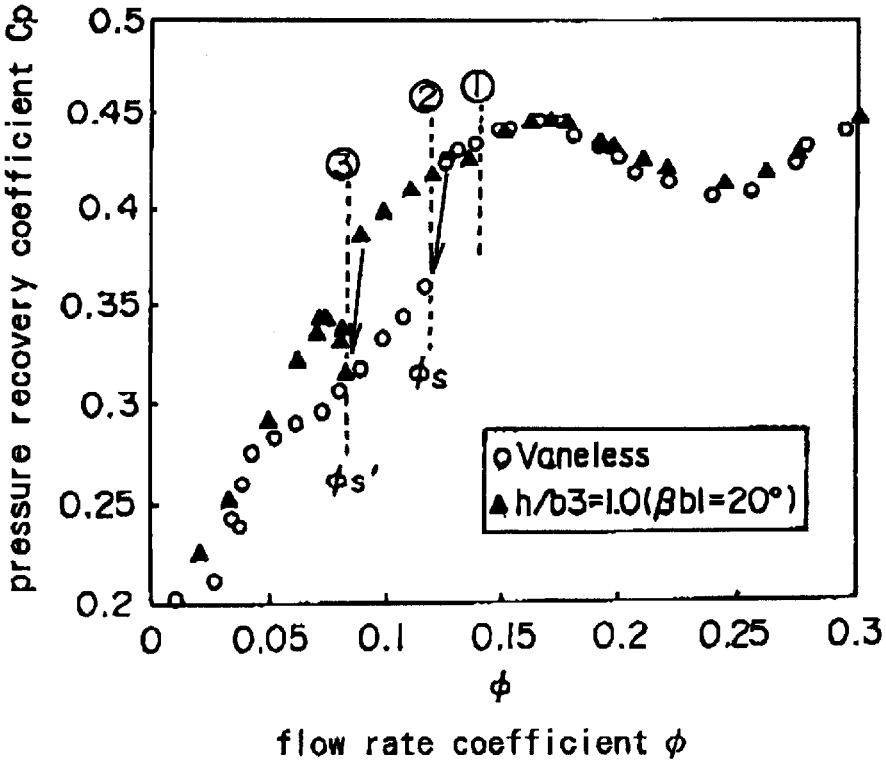
FIG. 6 is a graph showing the effects of a stabilization plate on the dynamics of fluid flow in the present system.

Next, an explanation will be given on how a rotating stall may be suppressed by introducing a stabilization plate 16 spanning across the entire width of the diffuser section 14. The effect of placing the stabilization plate 16 to generation of the reversed flow region is shown in FIG. 5. Hatching indicates reversed flow regions, and the contour curves indicate lines of equal levels of periodic velocity fluctuation energy. In this case, the stabilization plate is installed so as to span the reversed flow regions on the inner surfaces of the front shroud where the periodic velocity fluctuation energy is highest. FIG. 6 shows the results of pressure recovery coefficient Cp in the diffuser section 14 when the stabilization plate 16 is installed in such a manner. Static pressure waveforms at the diffuser inlet to correspond to flow rates ①, ② and ③ in FIG. 6 are shown in FIGS. 7A–7E.

Figure 7A:
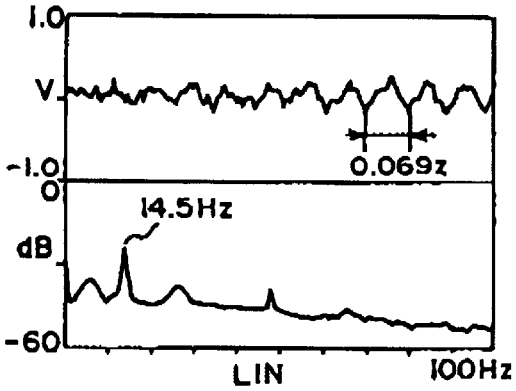
FIGS. 7A–7E are graphs showing the waveforms of static pressure fluctuation at different flow rates at the inlet to the present diffuser.
Figure 7B:
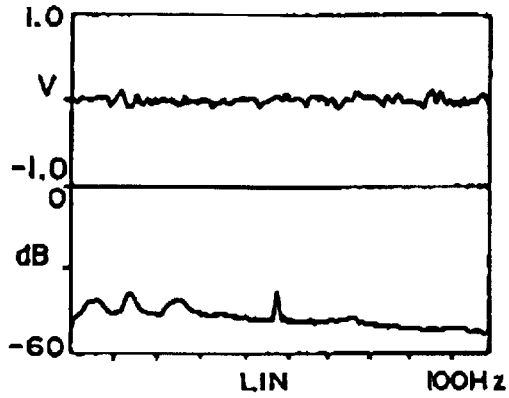

Analyses of the fluctuational frequency patterns indicate the following. FIG. 7A shows waveforms of a conventional diffuser without the plate 16 operating at flow rate to cause fluctuation ①, showing that fluctuation is initiated at a peak frequency of 14.5 Hz. In contrast, FIG. 7B shows waveforms of the present diffuser with the plate 16 aligned at an angle of 20 degrees across the entire width of the diffuser section 14, showing that the initial fluctuation ① is almost unrecognizable. In other words, the results show that instability in the reversed flow region is suppressed by the installation of a stabilization plate 16.

Figure 7C:
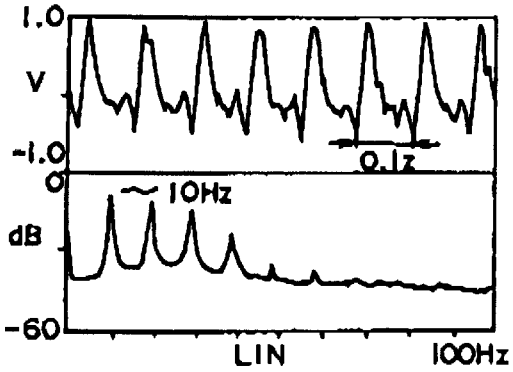
Figure 7D:
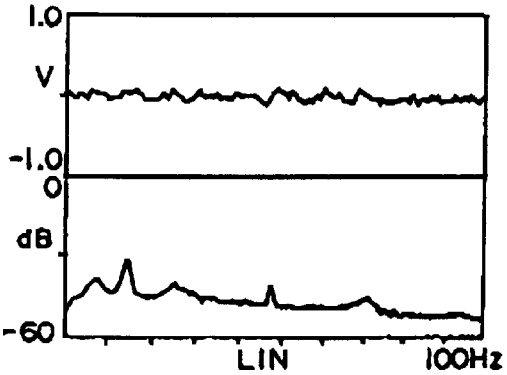
Figure 7E:
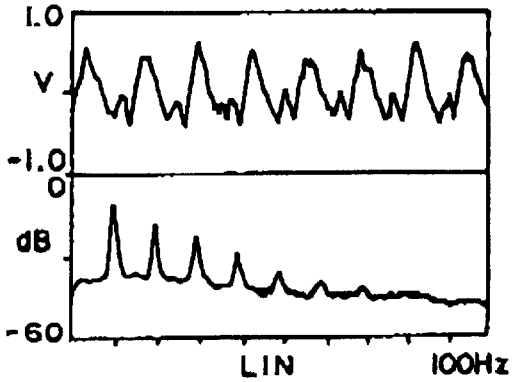

When the flow is further reduced to flow rate of fluctuation ②, waveforms shown in FIG. 7C indicate that while the conventional diffuser generates periodic static pressure fluctuation due to rotating stall at a peak frequency of 10 Hz, FIG. 7D shows that the present diffuser with the stabilization plate shows almost no change from the waveforms observed at flow rate ①.

The installation of one stabilization plate 16 in a vaneless diffuser reduces the rotating stall initiation flow rate $\phi$s' (flow rate ③) by about 35% compared with the conventional diffuser without the plate 16. Furthermore, when the plate 16 is installed, a slight drop in the flow rate to below the initiation flow rate $\phi$s' avoids a rotating stall, and the pressure recovery coefficient Cp increases. In other words, even if a rotating stall is initiated, the stabilization plate can restore the fluid dynamics within the diffuser section to recover from the rotating stall.

It is clear that by installing the stabilization plate 16 in the illustrated manner, an initiation of flow instability in the reversed flow regions, which triggers a rotating stall, is prevented and the rotating stall initiation flow rate is shifted towards the low flow rate, thereby increasing the stable operative range of the turbomachine.

Figure 8:
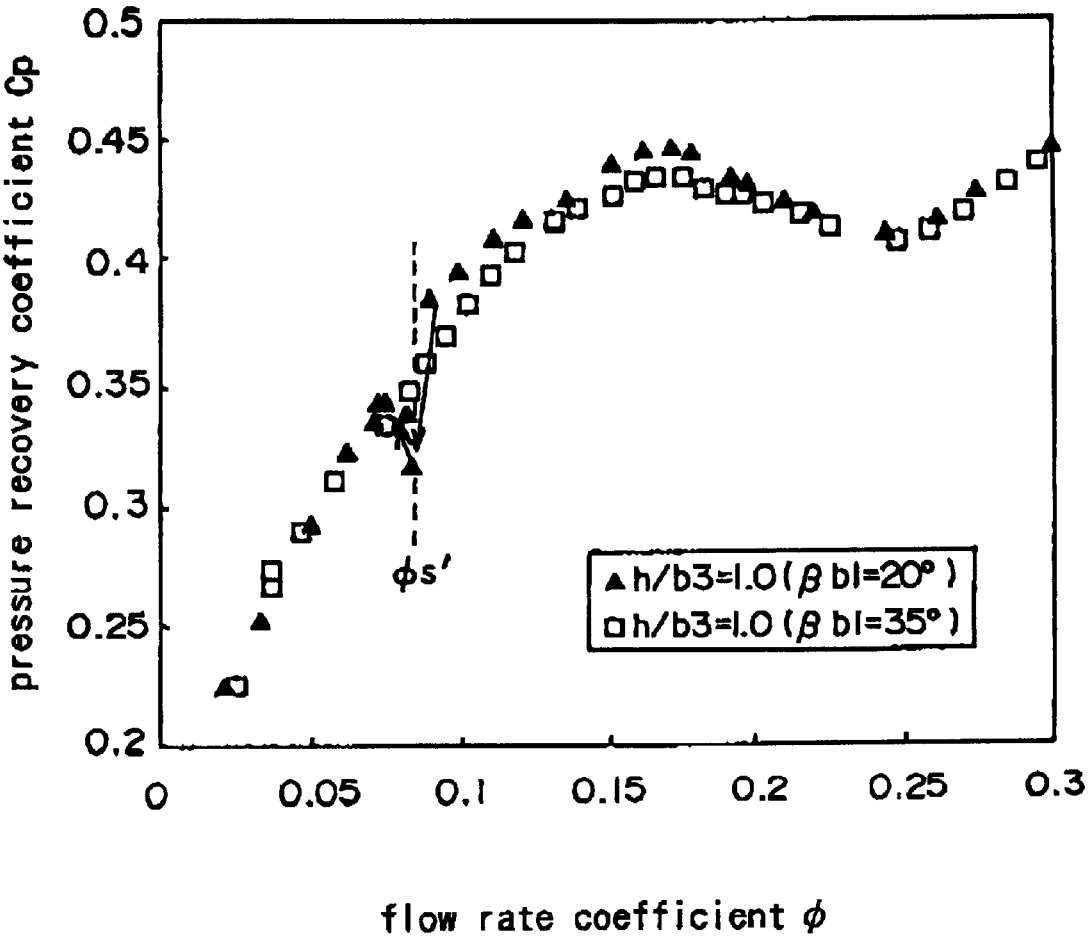
FIG. 8 is a graph showing the effects of alignment angle of the stabilization plates on the dynamics of fluid flow in the system.

Next, relation between the alignment angle of the stabilization plate 16 and rotating stall suppression effects will be explained. FIG. 8 compares two examples of the effects of alignment angles $\beta_{b1}$ (illustrated in FIG. 2) on turbomachine performance; in the first case, the plate 16 is oriented at 20 degrees to a tangent, and in the second case, the plate 16 coincides with the design flow rate angle of 35 degrees. When $\beta_{b1}$=20 degrees, a rotating stall is generated at the flow rate of $\phi$s'=0.08, as explained earlier, but when $\beta_{b1}$=35 degrees, rotating stall is not produced, and a sudden drop in pressure recovery coefficient Cp is not observed. In other words, stable operative range is increased by aligning the plate 16 at 35 degrees rather than 20 degrees.

Figure 9A:
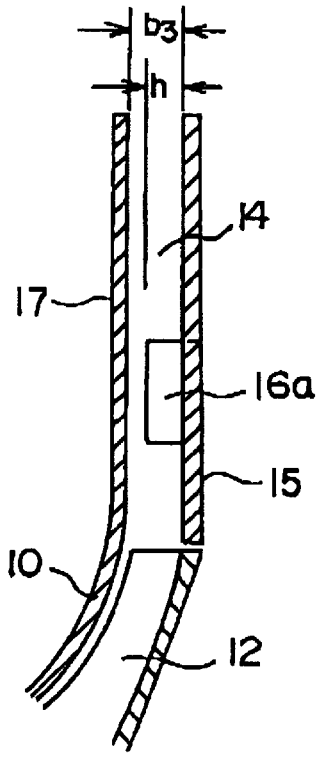
FIGS. 9A, 9B are cross sectional views of other embodiments of the present diffuser.
Figure 10A:
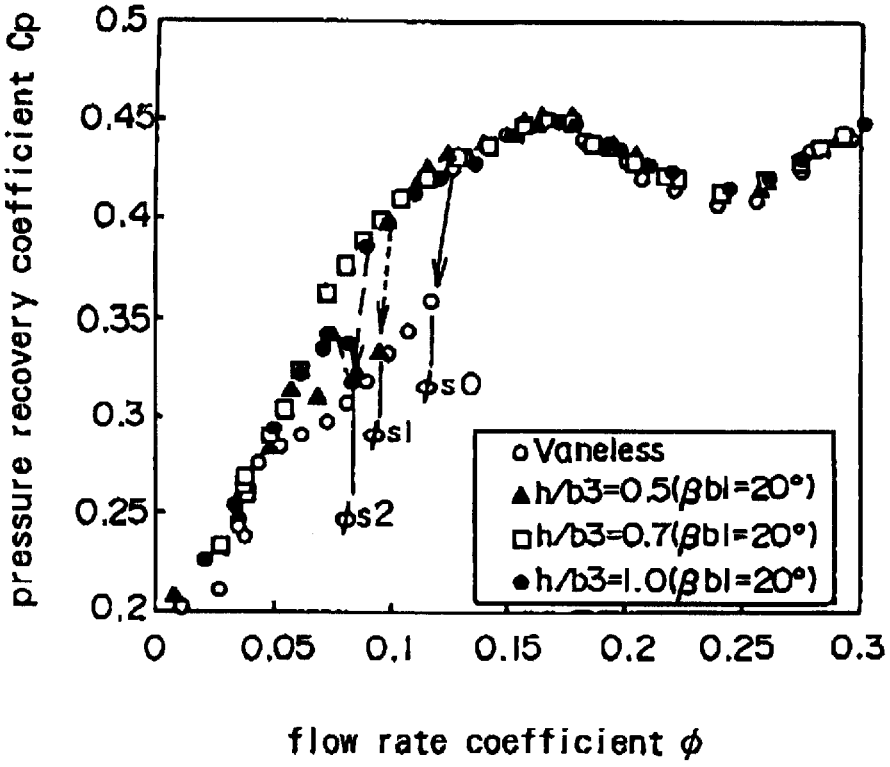
FIGS. 10A, 10B are graphs shoving the effects of the height of the stabilization plates on the dynamics of fluid flow in the present system.

FIG. 9A shows another embodiment of the stabilization plate. Stabilization plate 16*a* extends from main shroud 15, but it does not extend across the entire width of the diffuser section 14. A space ($b_3$–h) is provided between the tip of the plate 16 and the wall surface of the front shroud 17. FIG. 10A shows the behavior of the pressure reduction coefficient Cp in the diffuser section 14 having the plate 16*a* aligned at $\beta_{b1}$=20 degrees to the tangent direction when the height of the plate 16*a* is varied as h/$b_3$=0.5, 0.7 and 1.0. In the conventional diffuser without stabilization member, a rotating stall is generated at a flow rate of $\phi s_0$, at which point Cp drops discontinuously.

Figure 10B:
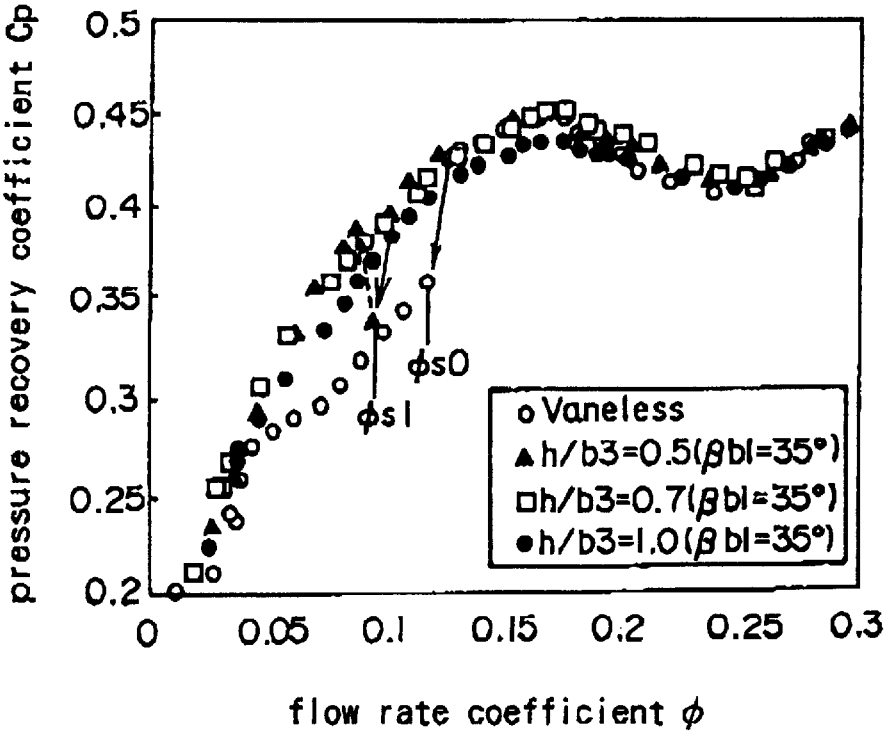

When the height of the stabilization plate 16*a* is varied from h/$b_3$=0.5 to 1.0, rotating stall is produced at respective flow rates $\phi s_1$ and $\phi s_2$. Compared with $\phi s_0$ for the conventional diffuser, the results indicate that the fluctuation initiation flow rates are shifted by about 20% for $\phi s_1$ and 35% for $\phi s_2$ towards the low flow rates. Although these results seem to show that the taller the plate, the better the effect of rotating stall suppression, however, it was discovered that when h/$b_3$=0.7, there was no sudden drop in Cp over the entire flow rates, indicating that the rotating stall has been suppressed completely. In effect, these results indicated that the suppression effect is improved by providing a suitable spacing between the tip of the plate 16*a* and the inner surface of the front shroud 17. This effect was also observed in FIG. 10B in the case of $\beta_{b1}$=35 degrees.

Figure 9B:
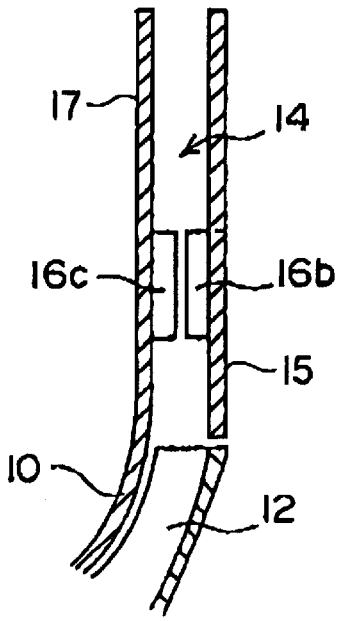
Figure 11A:
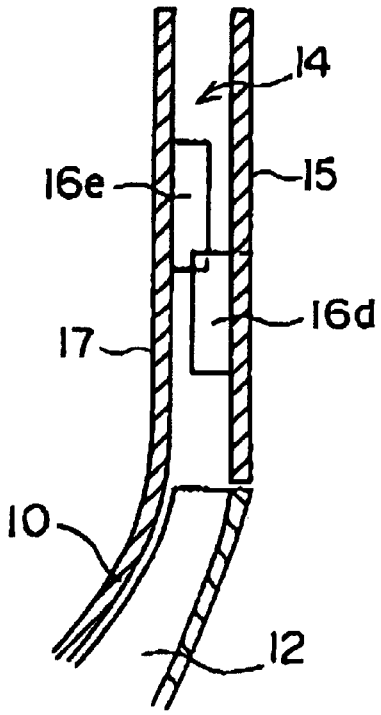
FIGS. 11A, 11B are, respectively, a cross sectional view and a plan view of another embodiment of the present diffuser.
Figure 11B:
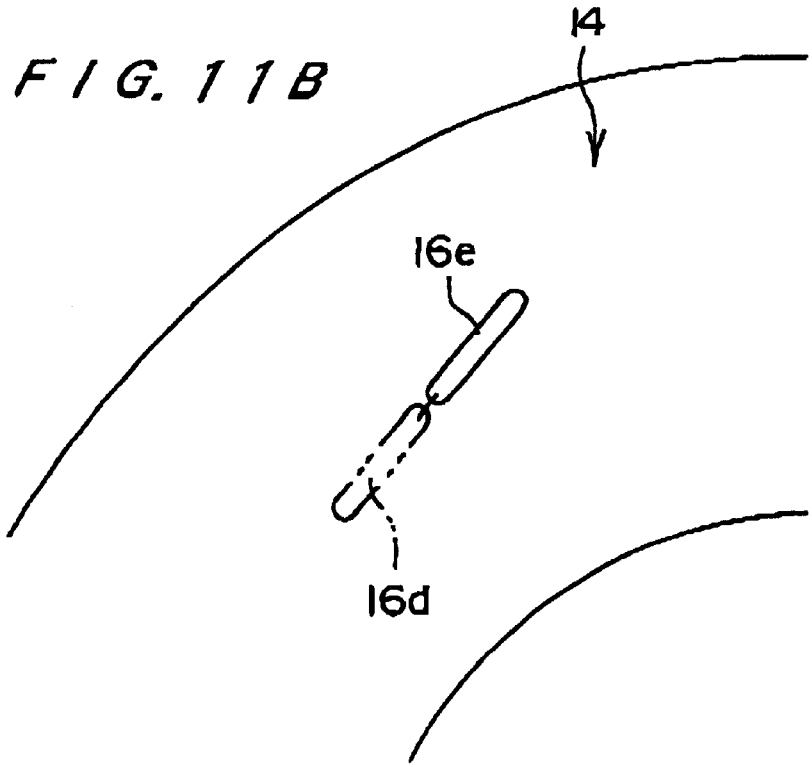

It should be noted that although the space was provided on the front shroud side of the diffuser shell by attaching the plate 16*a* on the main shroud of the diffuser shell, the spacing maybe provided on the main shroud side. Also, as shown in FIG. 9B, stabilization plates 16*b,* 16*c* may be attached on both sides of the diffuser shrouds 15, 17 to leave a central space. Also, as indicated in FIGS. 11A and 11B, the stabilization plates need not be located within the same flow field, but they may be displaced towards the up-stream side or down-stream side, as illustrated by plates 16*d,* 16*e.*

Figure 12B:
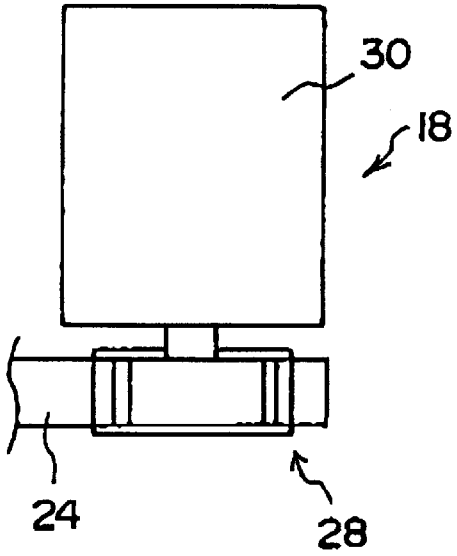
FIGS. 12A, 12B and 12C are plan view of another embodiment of the present diffuser.
Figure 12A:
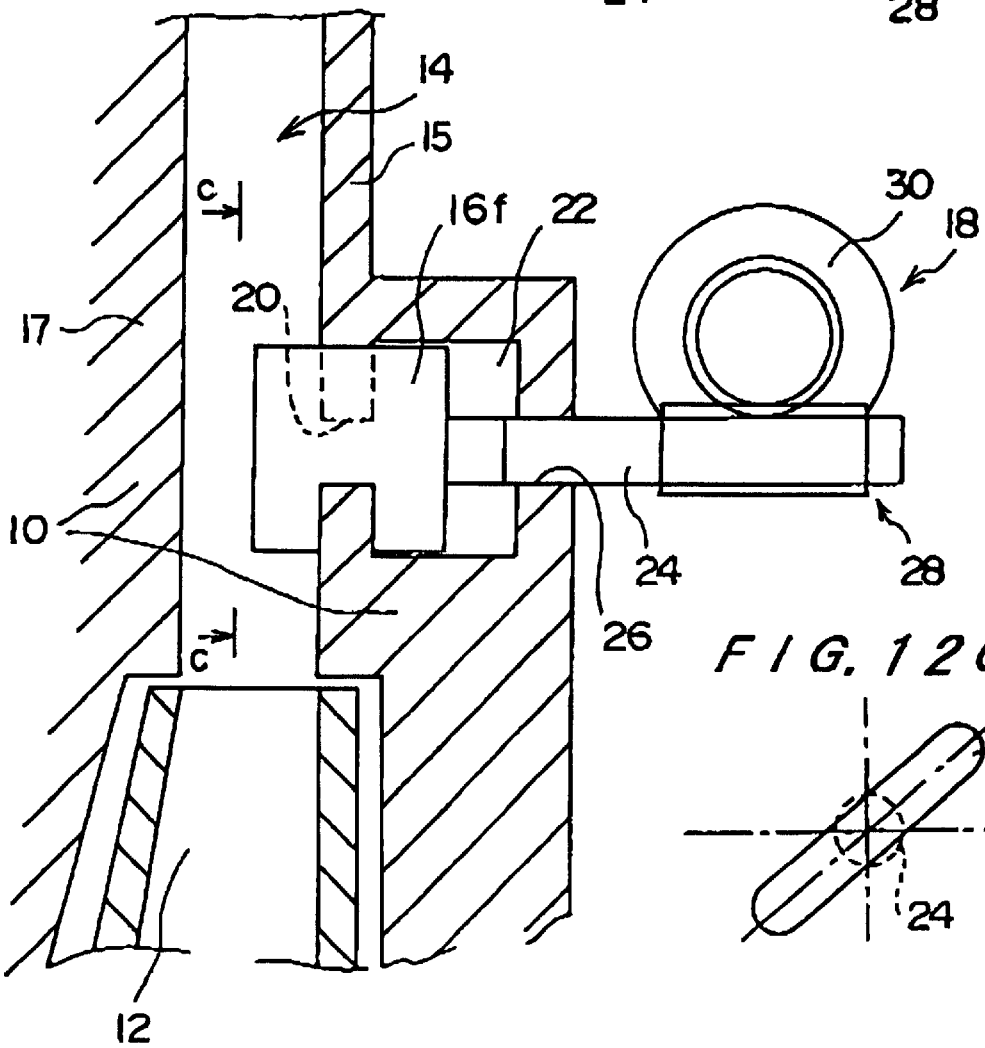
Figure 12C:
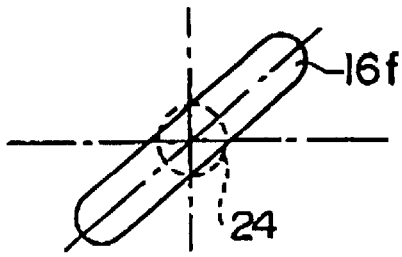

FIGS. 12A–12C show still other configurations of the centrifugal turbomachine of the present invention. In the diffuser section 14, a stabilization plate 16*f* is provided in such a way that the plate 16*f* can be inserted into or retracted from the diffuser section by operating a drive section 18. A control section (not shown) is provided for the drive section 18. The installation location, angle and other parameters are basically the same as those presented above.

That is, in a suitable location of the main shroud 15 at the side of the diffuser section 14, a slit 20 for inserting or retracting the plate 16*f* is provided, and a space 22 formed on the pump casing 10 is provided on the back side of the slit 20 for housing the plate 16*f.* A drive shaft 24 is attached to the proximal end of the plate 16*f,* which passes through a hole 26 formed on the casing 10 to be coupled to an external drive motor 30 through a rack-and-pinion coupling 28. The clearances between the slit 20 and the plate 16*f,* and between the hole 26 and the shaft 24 are filled with sealing devices.

In such an arrangement, the plate 16*f* is inserted into or retracted from the diffuser section 14 to control the generation of unstable fluctuation in the reversed flow regions. An example of other control method is that the flow rate is detected so that, when the flow data indicate that the system is operating below a critical flow rate and is susceptible to causing reverse flow to lead to instability, the plate 16*f* may be inserted into the diffuser section. Or, some suitable sensor may be installed to more directly detect approaching of an instability region and to alert insertion of the plate 16*f.* If the system is being operated away from the instability region, the plate 16*f* may be retracted from the diffuser section 14, thereby improving the operating efficiency.

In this embodiment, the plate 16*f* may be operated in a half-open position which was illustrated in FIG. 9A. In this case, the plate 16*f* is inserted into the diffuser section 14 in such a way to leave a space between the front shroud 17 and the wall surface. The space ($b_3$–h) is variable so that, by providing a suitable sensor to indicate the degree of flow stability in the diffuser section 14, the space distance can be controlled so that the sensor displays an optimum performance of the system. Or, the system may be controlled according to a pre-determined relationship between the degree of flow stability and flow rates or other parameters.

Figure 13A:
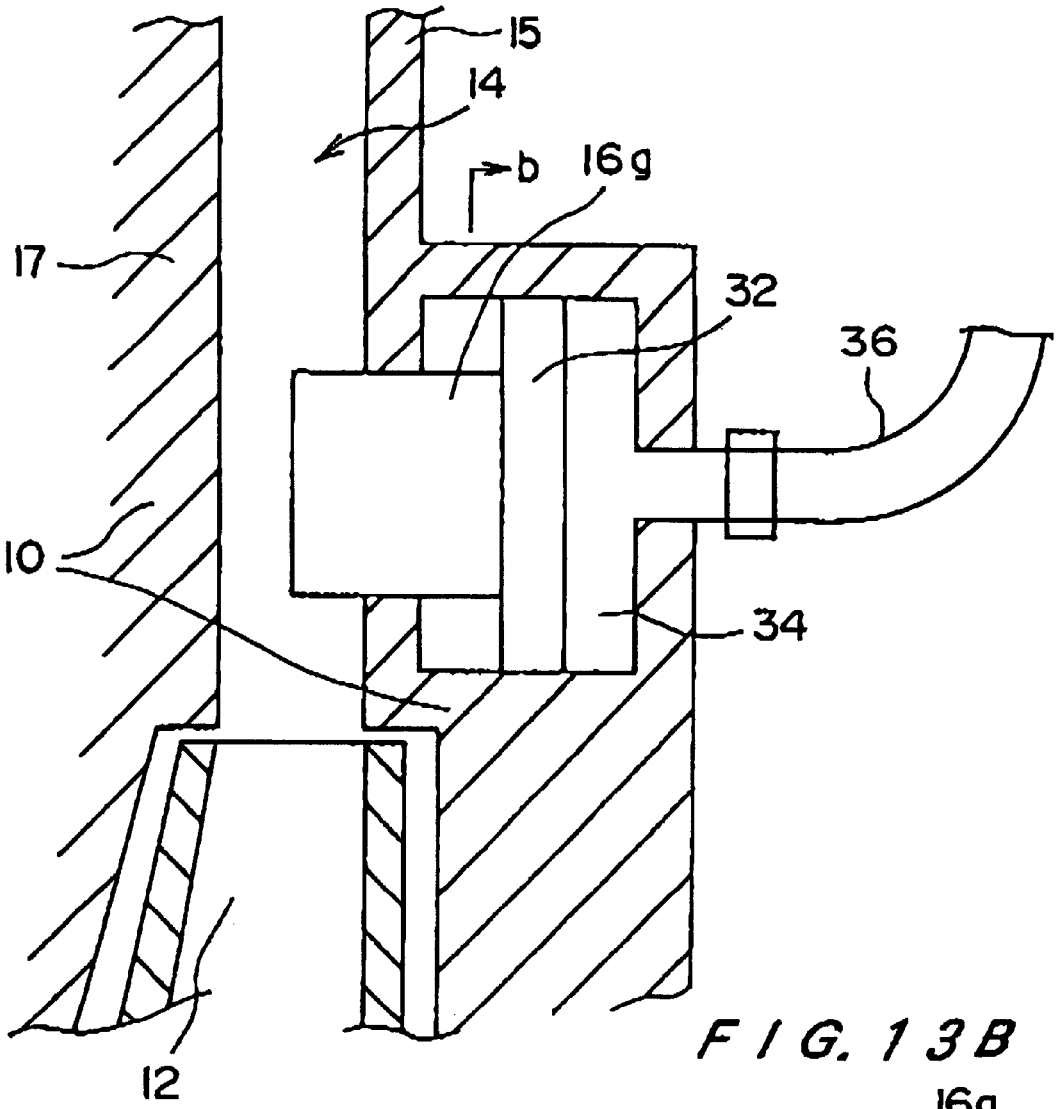
FIGS. 13A, 13B are, respectively, a cross sectional view and a plan view of yet another embodiment of the present diffuser.
Figure 13B:
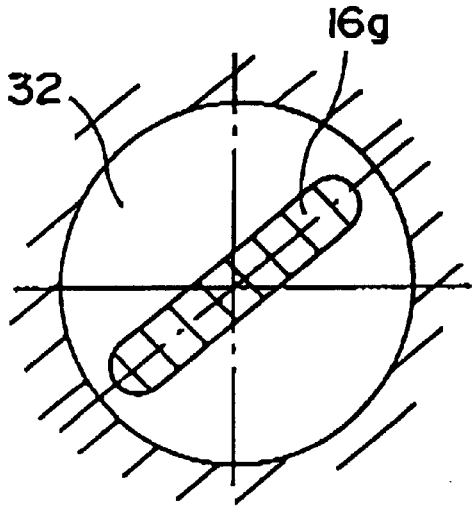

FIG. 13 shows another embodiment of the operating mechanism for the plate. In this arrangement, the stabilization plate 16*g* is attached to a piston disc 32 housed in a cylinder chamber 34, which is operated by a fluid pressure device through a pipe 36. The effects are the same as those presented earlier. The orientation angle of the stabilization plate can be made variable by employing suitable means.

Next, the second embodiment will be described below.

Figure 14:
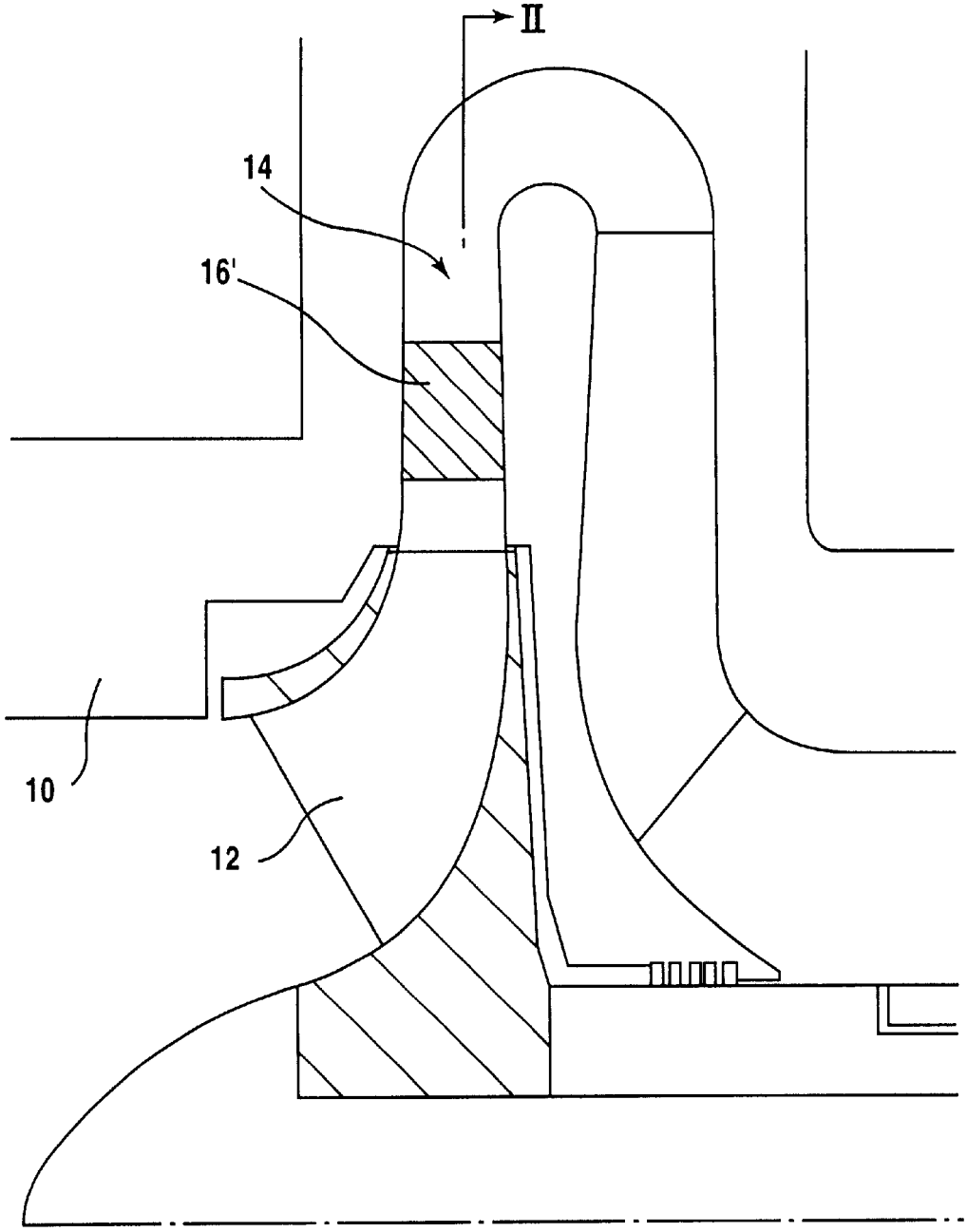
FIG. 14 is a partial cross sectional view of a second embodiment of the turbomachine of the present invention.

FIG. 14 is a cross-sectional view of a centrifugal compressor. In FIG. 14, the reference numeral 12 represents an impeller, the reference numeral 14 represents a diffuser, and the reference numeral 16' represents a stabilization member.

Figure 15B:
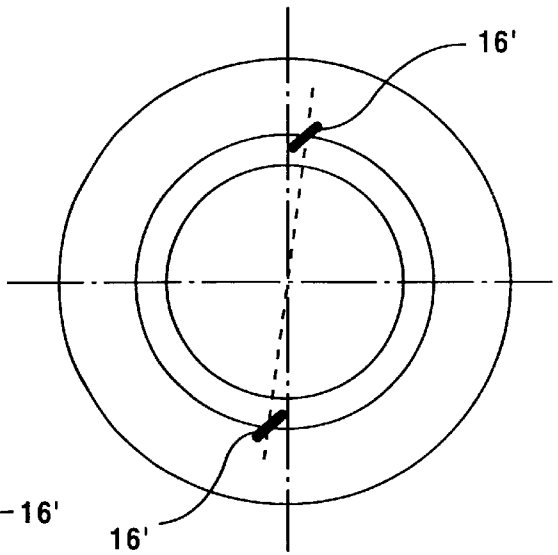
FIG. 15 is a sectional view seen through a plane at II in FIG. 14, in which FIG. 15B particularly shows the second embodiment of the present invention.
Figure 15C:
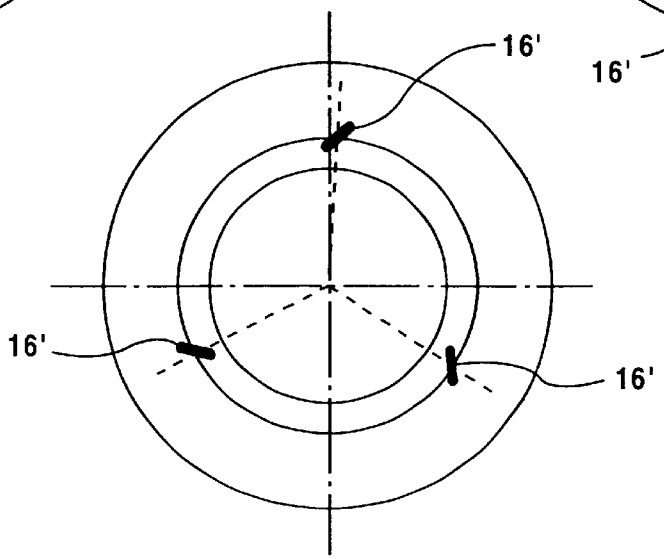
Figure 15A:
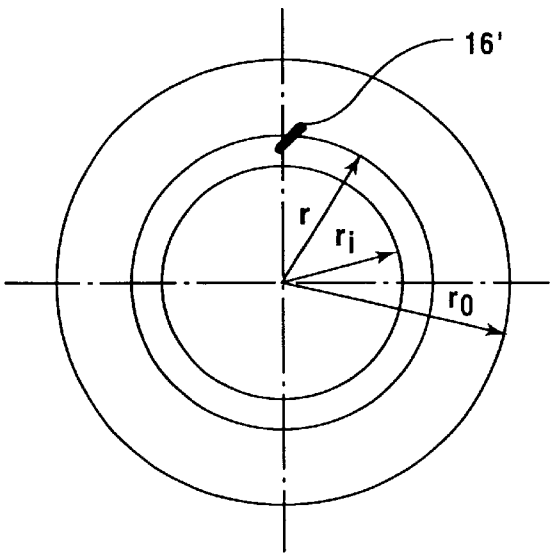

FIGS. 15A, 15B and 15C are views for showing arrangement of a stabilization member or members. In FIG. 15A, one stabilization member 16' is arranged, in FIG. 15B, two stabilization members 16', 16' are arranged, and in FIG. 15C, three stabilization members 16', 16', 16' are arranged. If a plurality of stabilization members are arranged, then the stabilization members are positioned at angularly equal intervals. Here, r is a radius of the position of the stabilization member 16', ri is a radius at an exit of the impeller, and is a radius at an exit of the diffuser.

Figure 16:
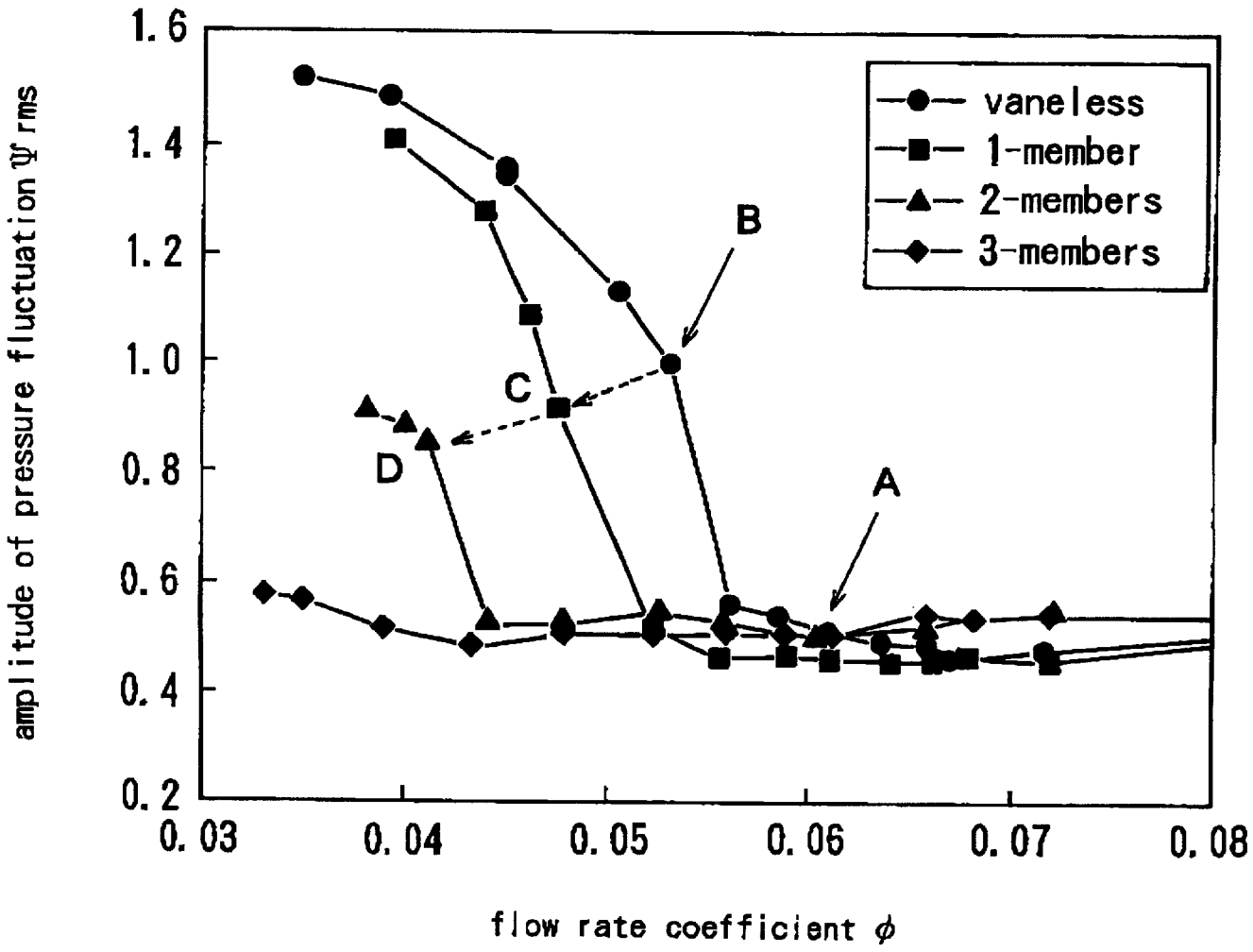
FIG. 16 is a graph showing the effects of stabilization in an amplitude of pressure fluctuation (root mean square value) $\psi$rms and flow rate coefficient $\phi$.

FIG. 16 is a graph showing the amplitude of static pressure fluctuations at the diffuser inlet. In FIG. 16, the horizontal axis represents the flow coefficient $\phi$ of the compressor, and the vertical axis represents the amplitude of static pressure fluctuation $\psi$rms at the diffuser inlet. The amplitude of the static pressure fluctuation is expressed in root mean square value of dimensionless number. FIG. 16 indicates that the amplitude of static pressure fluctuations $\psi$rms increases steeply at the point B, if the stabilization member is not provided (indicated as vaneless in FIG. 16). Also, the amplitude of static pressure fluctuations $\psi$rms increases steeply at the point C, if one stabilization member is provided (indicated as 1-member in FIG. 16). Also, the amplitude of static pressure fluctuations $\psi$rms increases steeply at the point D, if two stabilization members are provided (indicated as 2-member in FIG. 16).

By providing the stabilization member at one position or providing the stabilization members at two positions, the increasing point in the amplitude of static pressure fluctuation is shifted from B to C or D toward the low flow rate side. That is, by providing the stabilization member or members, the stable operation range in the compressor is expanded because a rotating stall initiating flow rate becomes a low flow rate. In the case where the stabilization members are provided at three positions, as 3-members in FIG. 16, the increasing point in the amplitude of static pressure fluctuation is not generated. That is, the stable operation is possible up to the shutoff point or thereabout, if more than 3-members are provided.

Figure 17A:
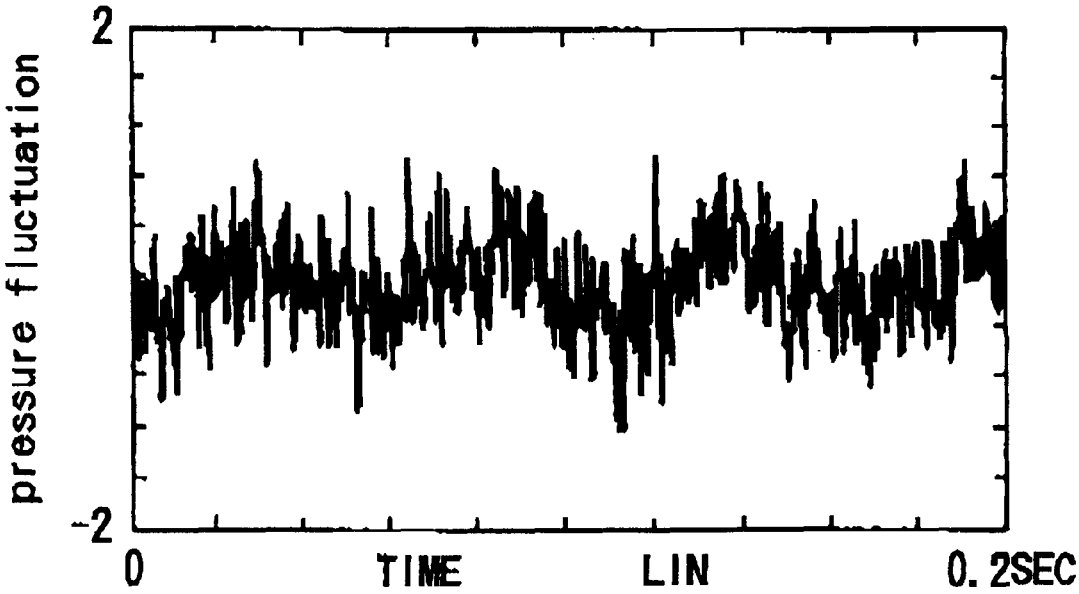
FIG. 17A and 17B are graphs showing the waveforms of pressure fluctuations at different operating points A, B respectively in FIG. 16.
Figure 17B:
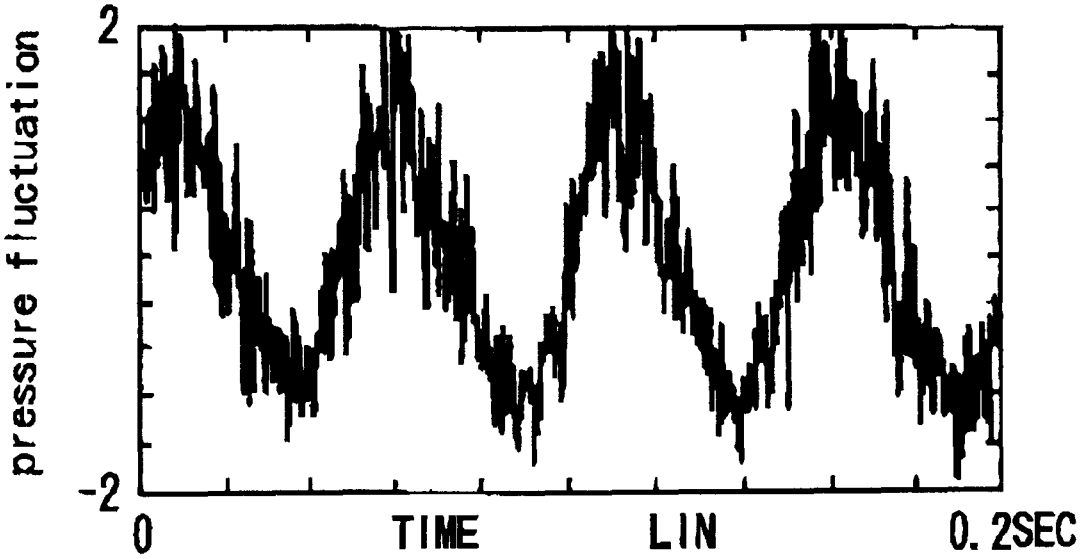

FIG. 17A and 17B are graphs showing the pressure fluctuations at operating points A and B in FIG. 16. FIG. 17A indicates that periodic fluctuations are not generated at the point A. FIG. 17B indicates that periodic fluctuations which are a phenomenon of flow instability in the diffuser section are generated at the point B due to generation of the rotating stall. The amplitude of static pressure fluctuations shown in FIG. 16 increases suddenly at the points B, C, D due to these periodic fluctuations.

Figure 18:
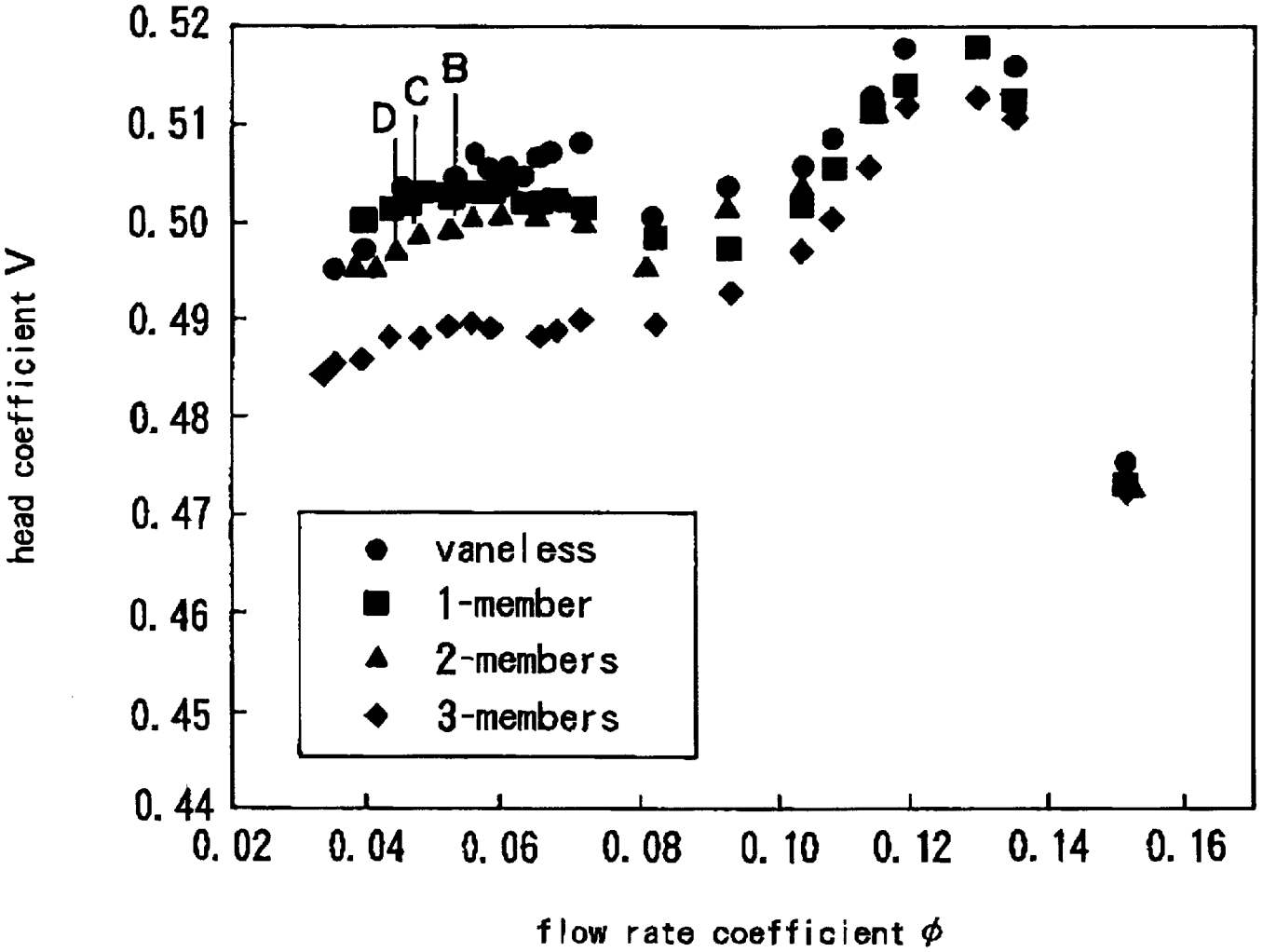
FIG. 18 is a graph showing the effects of head coefficient in the compressor by stabilizing plate(s) in head coefficient V and flow rate coefficient $\phi$.

FIG. 18 is a graph showing the head coefficient in the compressor. In the case where one or two stabilization members are provided at one position or two positions, the head coefficient is lowered to a degree smaller than that in the vaneless diffuser. If the stabilization members are provided at three positions, then the head coefficient is lowered to a large degree, comparing to that in the vaneless diffuser or 1-member or 2-members cases. In FIG. 18, the operating points B, C, and D correspond to generating points of the rotating stall in the vanelss, one stabilization member, and two stabilization members, respectively.

In consideration of balance of the lowering degree of the head coefficient and the effect of stabilization, it is judged that the case where the stabilization members are provided at two positions is optimum. Therefore, the second embodiment of the present invention adopts two stabilization members at two positions in the diffuser. The stabilizing member is a plate member having a predetermined angle with respect to a direction of flow through the diffuser section, which is extending across an entire width of a fluid flow path of the diffuser section. However, a height dimension of the plate member may be smaller than a width dimension of a fluid flow path of the diffuser section. The stabilization member may be inserted into or retracted away from said diffuser section by plate driver means as described in the first embodiment. Other features of the stabilization member are same as described in the first embodiments.

Figure 19A:
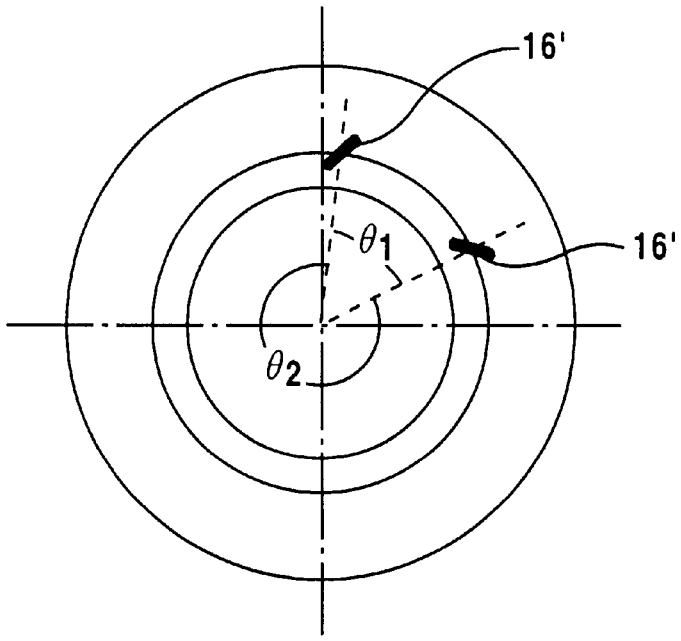
FIGS. 19A, 19B are sectional views showing variations of the second embodiment of the present invention.
Figure 19B:
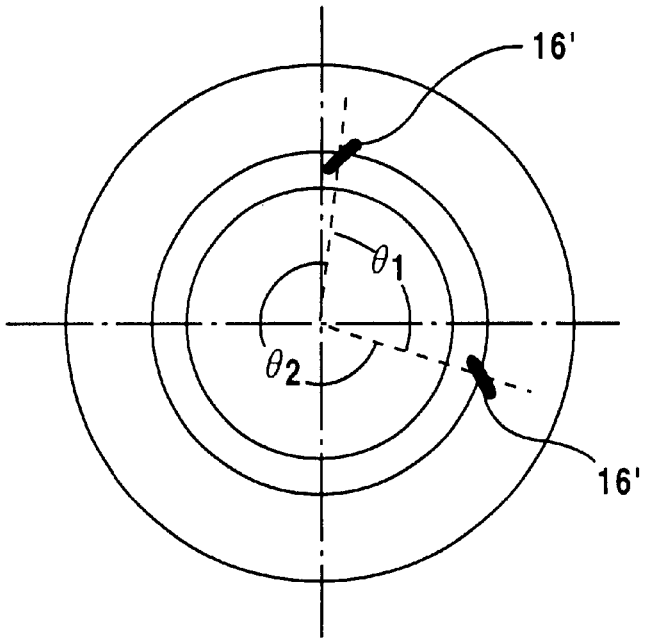

FIG. 19A and 19B show a variation of the second embodiment, which has two plate members symmetrically disposed in the diffuser section. Contrary to the two plate members in FIG. 15B, the present embodiments show that two plate members are asymmetrically disposed at unequal angles $\theta_1$, $\theta_2$. Namely, $\theta_1$ and $\theta_2$ is not equal. The effect of the two plate members as shown in FIGS. 19A and 19B is almost the same as described above. Therefore, the two plate members may be disposed at unequal angles.

Although certain preferred embodiments of the present invention have been shown and described in detail, it should be understood that various changes and modifications may be made therein without departing from the scope of the appended claims.

What is claimed is:

1. A turbomachine having an impeller and a diffuser section, wherein two stabilization members are disposed in two predetermined locations of said diffuser section to prevent a generation of unstable flow in said diffuser section during a low flow rate operation of said turbomachine.

2. A turbomachine according to claim 1, wherein said stabilization members are plate members each having a predetermined angle with respect to a direction of flow through said diffuser section.

3. A turbomachine according to claim 2, wherein said plate members each extend across an entire width of a fluid flow path of said diffuser section.

4. A turbomachine according to claim 2, wherein a height dimension of said plate members is smaller than a width dimension of a fluid flow path of said diffuser section to provide a space between each of said plate members and an opposing wall surface of said diffuser section.

5. A turbomachine according to claim 2, wherein said stabilization members are inserted into, or retracted away from, said diffuser section by plate driver means.

6. A turbomachine according to claim 5, wherein said plate members each have a height h which is related to a width dimension $b_3$ of said diffuser section according to a relation $h/b_3>0.5$.

7. A turbomachine according to claim 2, wherein said plate members are aligned at an angle greater than that of a stream flowing at a rotating stall-initiating flow rate into said diffuser section.

8. A turbomachine according to claim 1, wherein said stabilization members each comprise two plate members protruding from both sides of said diffuser.

9. A turbomachine according to claim 1, wherein said stabilization members are located at a radial position r, such that r/ri is substantially 1.21, wherein ri is a radius at an exit of said impeller.

* * * * *

UNITED STATES PATENT AND TRADEMARK OFFICE

CERTIFICATE OF CORRECTION

PATENT NO. : 6,347,921 B1
APPLICATION NO. : 09/542869
DATED : February 19, 2002
INVENTOR(S) : Hiroyoshi Watanabe et al.

It is certified that error appears in the above-identified patent and that said Letters Patent is hereby corrected as shown below:

On the Title Page, Item (30); Foreign Application Priority Data

Please insert a Foreign Application Priority Data which should read,

--Oct. 9, 1997 (JP) ... 9-293312--.

Signed and Sealed this

Twelfth Day of June, 2007

JON W. DUDAS
*Director of the United States Patent and Trademark Office*